US010201223B2

(12) United States Patent
Yoon et al.

(10) Patent No.: US 10,201,223 B2
(45) Date of Patent: Feb. 12, 2019

(54) FOLDABLE DESK WITH FOLDABLE CHAIR

(71) Applicants: Il Shik Yoon, Gyeonggi-do (KR); Jun Chan Yoon, Seoul (KR)

(72) Inventors: Il Shik Yoon, Gyeonggi-do (KR); Jun Chan Yoon, Seoul (KR)

( * ) Notice: Subject to any disclaimer, the term of this patent is extended or adjusted under 35 U.S.C. 154(b) by 0 days.

(21) Appl. No.: 15/511,536

(22) PCT Filed: Jun. 8, 2015

(86) PCT No.: PCT/KR2015/005706
§ 371 (c)(1),
(2) Date: Jul. 14, 2017

(87) PCT Pub. No.: WO2016/043408
PCT Pub. Date: Mar. 24, 2016

(65) Prior Publication Data

US 2017/0332777 A1 Nov. 23, 2017

(30) Foreign Application Priority Data

Sep. 15, 2014 (KR) ..... 10-2014-0121953

(51) Int. Cl.
*A47B 3/14* (2006.01)
*A47B 39/04* (2006.01)
(Continued)

(52) U.S. Cl.
CPC ..... *A47B 3/14* (2013.01); *A47B 39/06* (2013.01); *A47B 39/023* (2017.08)

(58) Field of Classification Search
CPC ..... A47B 3/14; A47B 39/06; A47B 39/023
(Continued)

(56) References Cited

U.S. PATENT DOCUMENTS 1,173,480 A * 2/1916 Bulik ..... A47B 39/00 108/162
1,367,908 A * 2/1921 Karschitz ..... A47B 3/14 297/172 X (Continued)

*Primary Examiner* — Rodney B White
(74) *Attorney, Agent, or Firm* — Richard John Bartz

(57) ABSTRACT

The present invention relates to a foldable desk, in which a desk board is movable in front and back directions so as to fit a body shape of a user and a chair and a desk are completely foldable and overlap for space utilization, and a frame 50 of a desk board 10 is rotatably connected to a desk board support frame 60 through a connection rod 13, the desk board support frame 60 is bent at a right angle in a state where the desk board 10 is accurately positioned at a position, at which the desk board 10 exerts a function of a desk, and a first upper edge 62 of a desk board support frame having a larger length than a thickness of the desk board and a first upper edge 32 of the connection frame simultaneously support a bottom surface of the desk board 10, a connection rod 13 is shorter than a second upper edge 64 of the desk board support frame 60 coupled to the connection rod 13 to allow the desk board 10 to slide next to the first upper edge 62 of the desk board support frame, and the desk board 10 is bent downwardly at a right angle in the state where the desk board 10 has slide next to the first upper edge 62 of the desk board support frame, when a chair seat 40 is in an accurately positioned state, in which the chair seat 40 serves as a chair, a bottom surface of the chair sheet is supported to a support part 35 protruding to an inner side of a second upper edge 34 lower than the first upper edge 32 of the connection frame 30, and the chair sheet 40 is completely folded upwardly and overlap a backrest 20, and a backrest support frame 70 is foldable at a right angle so as to overlap the connection frame 30 in the state where the chair seat 40 is folded upwardly, and the protruding part 35 is positioned in a space between a first leg and a second leg 72 and 74 of (Continued)

the backrest support frame in the folded state of the backrest support frame 70.

12 Claims, 9 Drawing Sheets

(51) Int. Cl.
*A47B 39/06* (2006.01)
*A47B 83/02* (2006.01)
*A47B 39/02* (2006.01)

(58) Field of Classification Search
USPC ..... 297/160, 161, 162, 170, 171, 172
See application file for complete search history.

(56) References Cited

U.S. PATENT DOCUMENTS 2,162,560 A * 6/1939 Larsen ..... A47B 39/00
297/171
2,300,608 A * 11/1942 Yusek ..... A47B 83/00
297/170
2,459,257 A * 1/1949 Wood ..... A47B 39/00
297/172 X
2,732,007 A * 1/1956 MacWhirter ..... A47B 39/02
297/172 X
3,622,199 A * 11/1971 Ho ..... A47B 39/02
297/172 X
4,067,606 A * 1/1978 Desmoulins nee Fouchereau .....
A47B 3/14
297/170 X
4,289,350 A * 9/1981 Thomas ..... A47B 3/14
297/172 X
4,921,302 A * 5/1990 Godwin ..... A47B 39/00
297/170 X
5,697,668 A * 12/1997 Chao ..... A47B 39/02
297/172 X
6,953,222 B2 * 10/2005 Larrick ..... A47C 9/08
297/172 X
7,314,248 B2 * 1/2008 Mabon ..... A47B 9/08
297/172 X
8,459,734 B2 * 6/2013 Herschler ..... A47B 83/02
297/170 X

* cited by examiner

[Fig. 1]
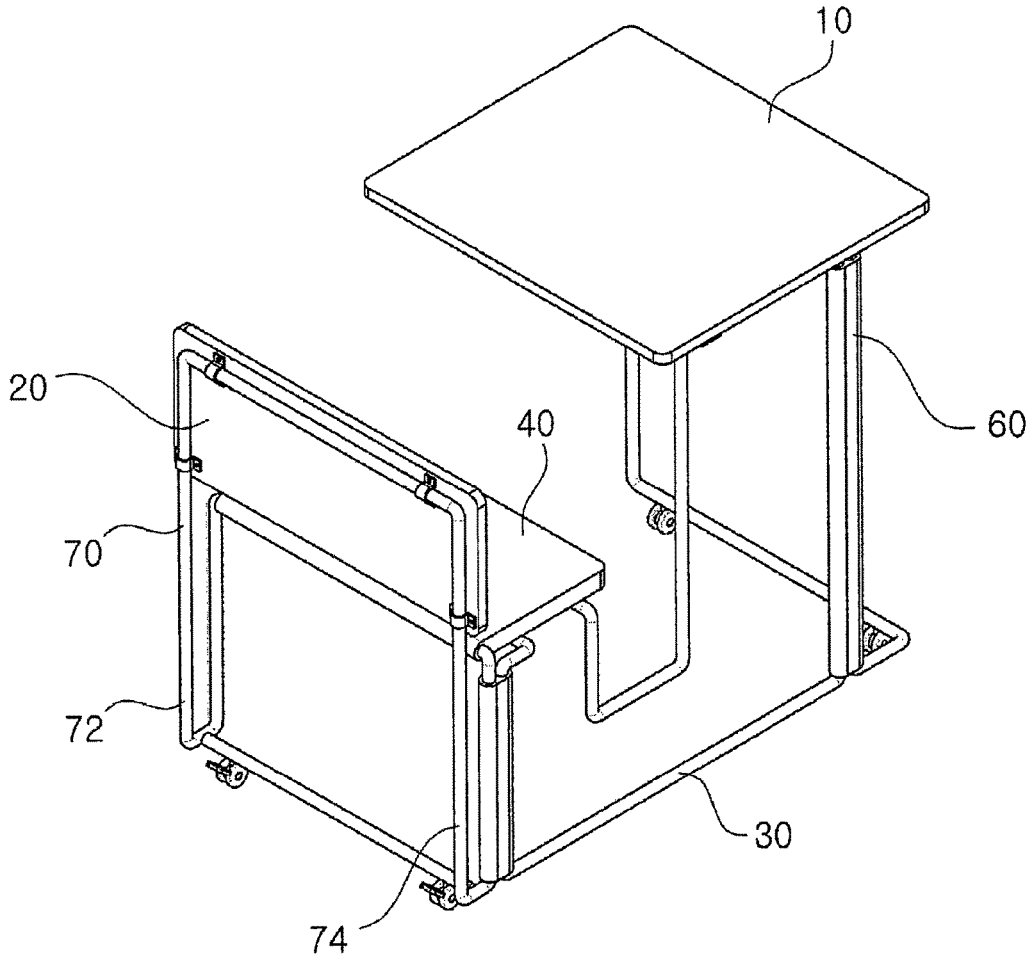

[Fig. 2]
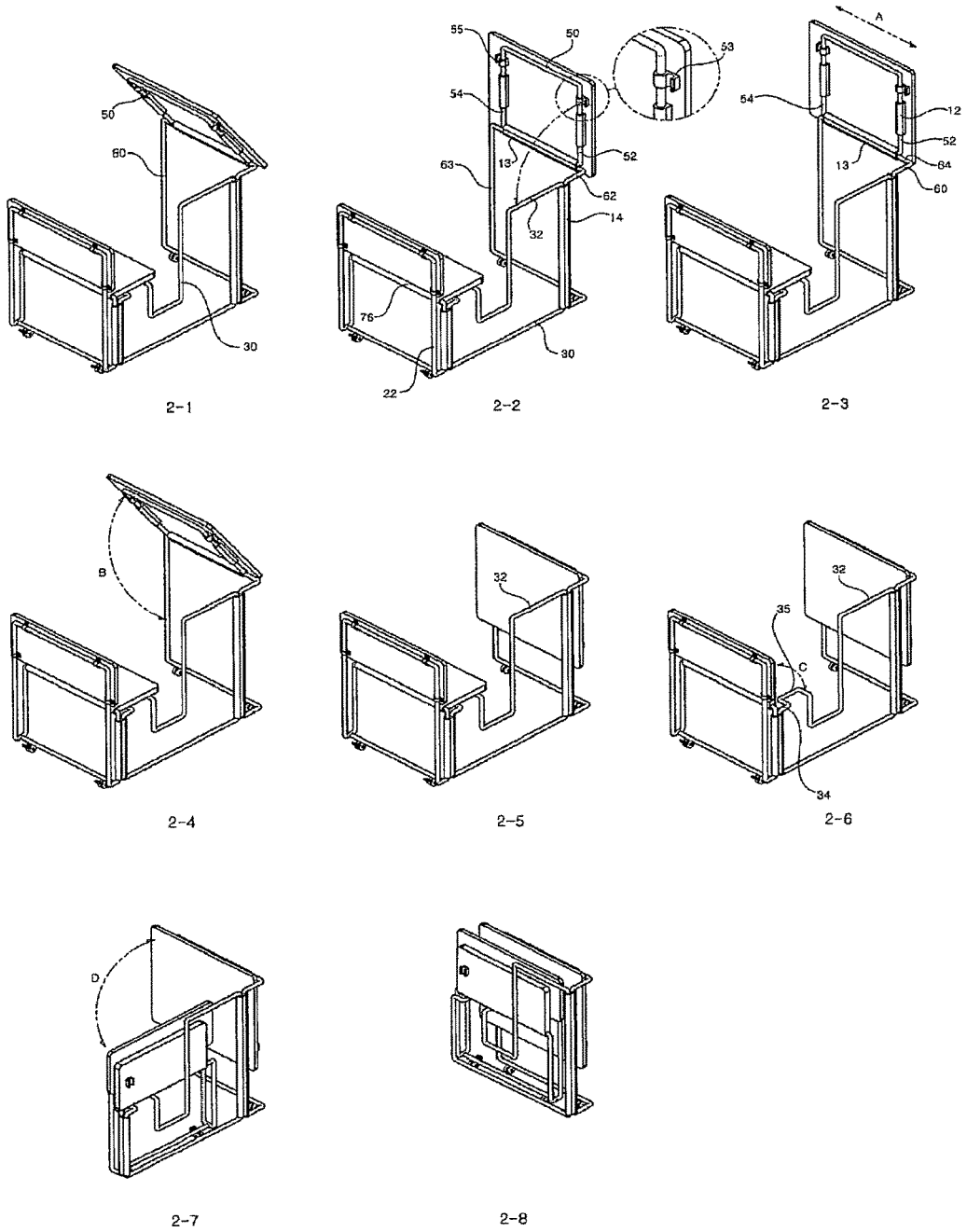

[Fig. 3]
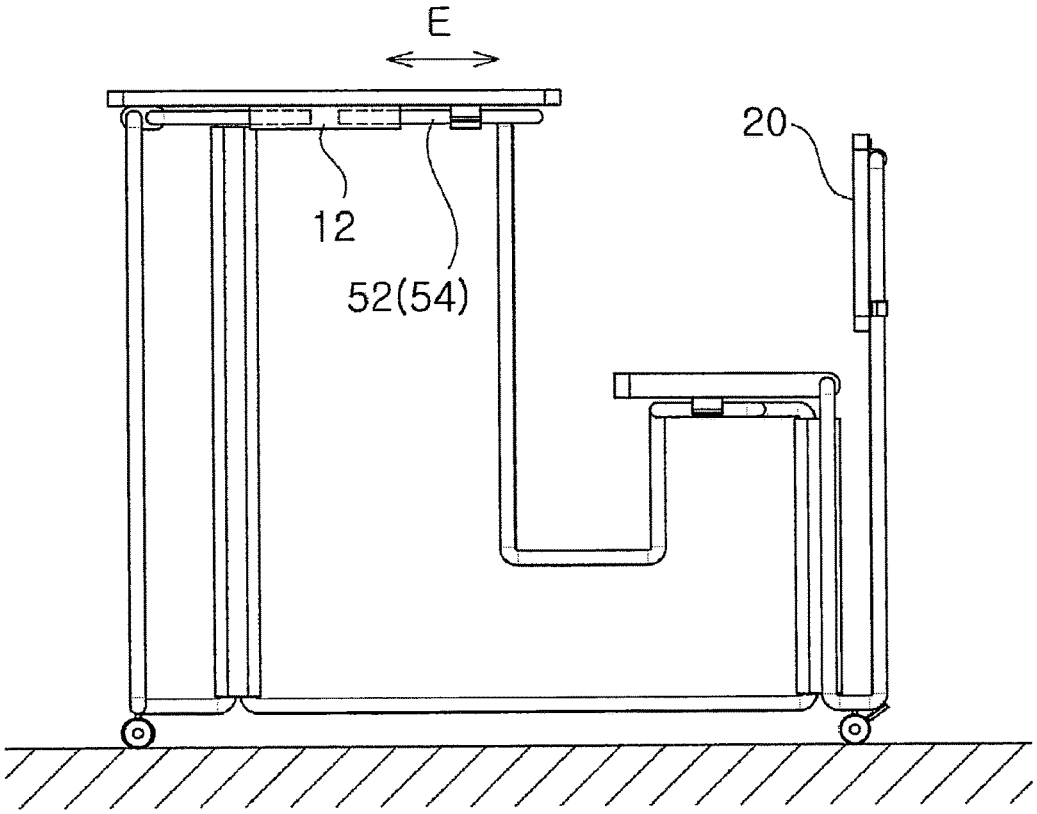

[Fig. 4]
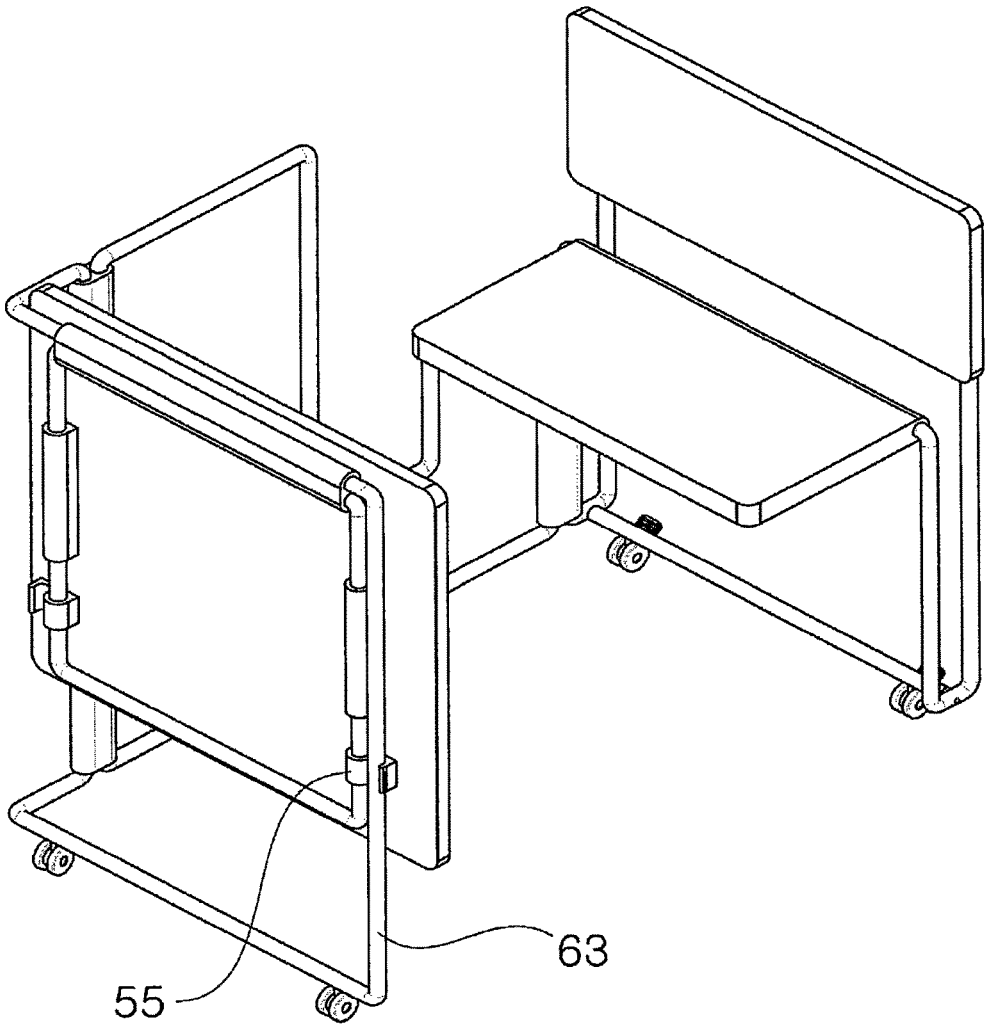

[Fig. 5]
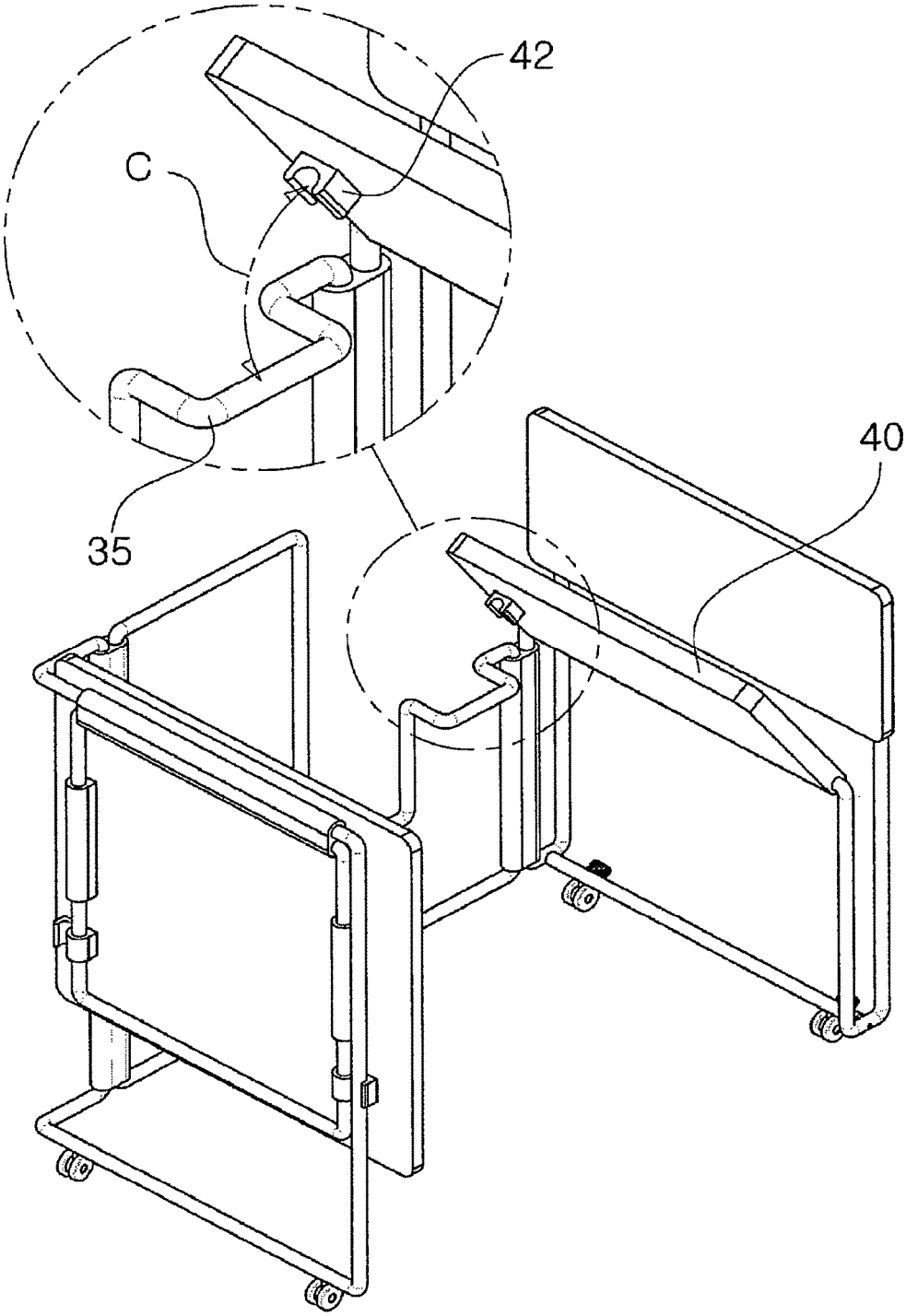

[Fig. 6]
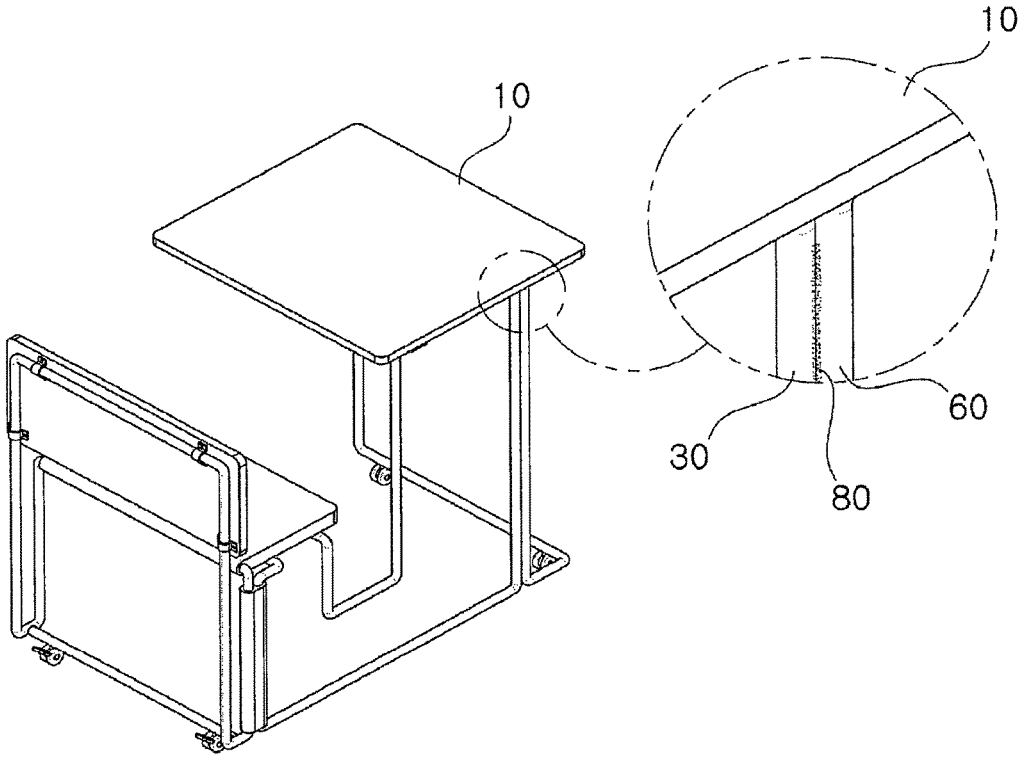

[Fig. 7]
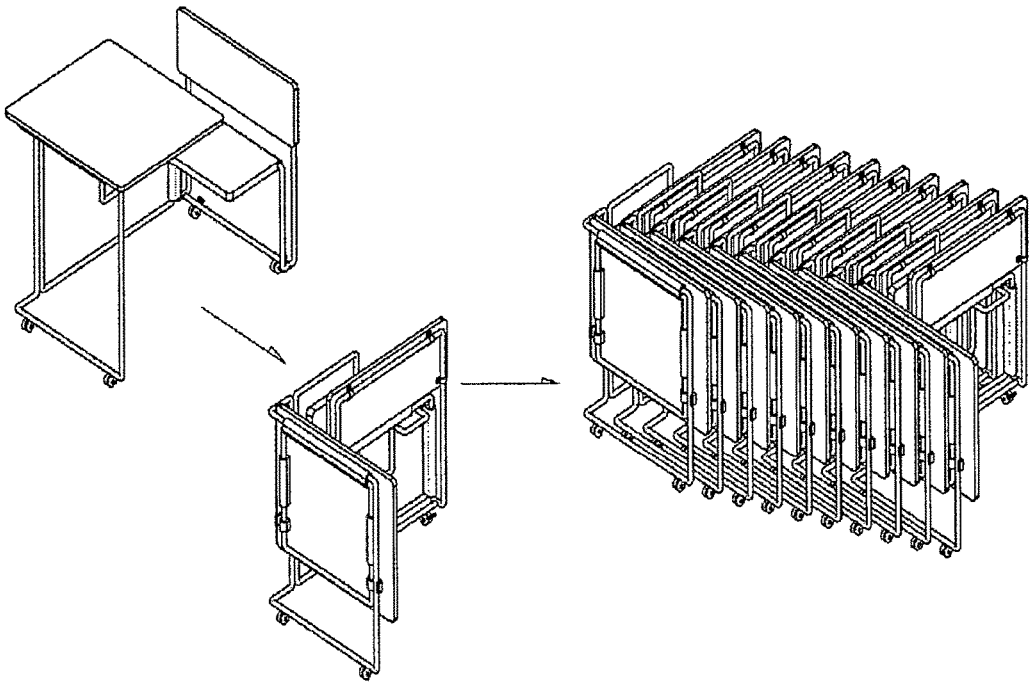

[Fig. 8]
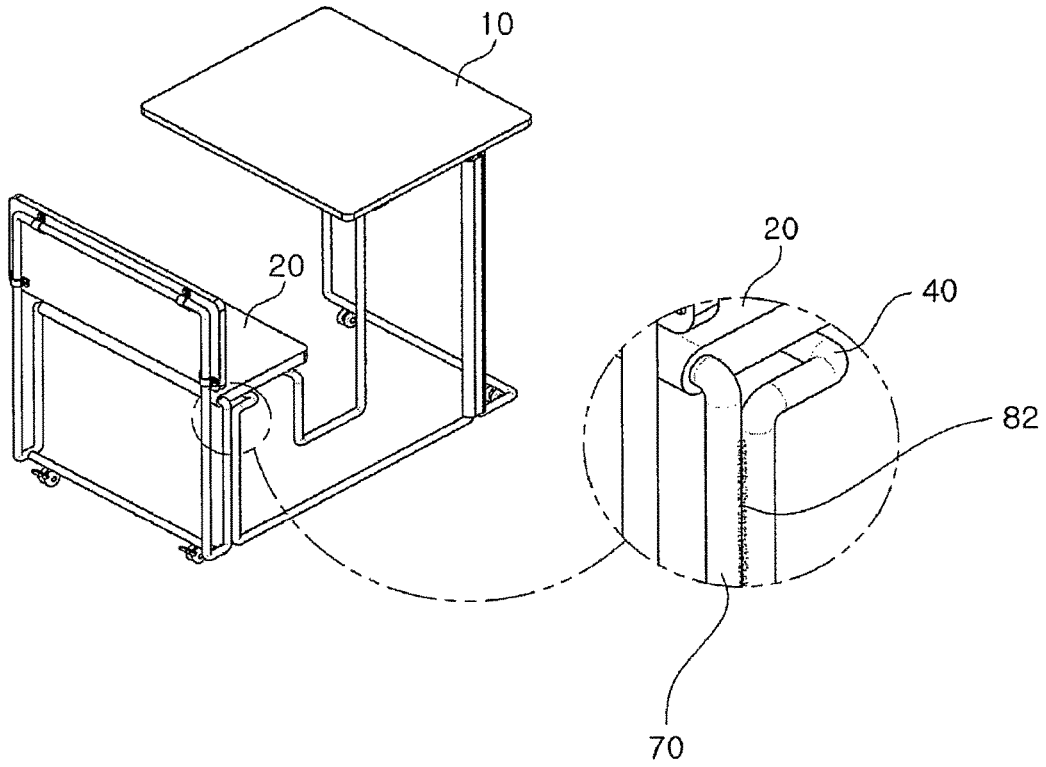

[Fig. 9]
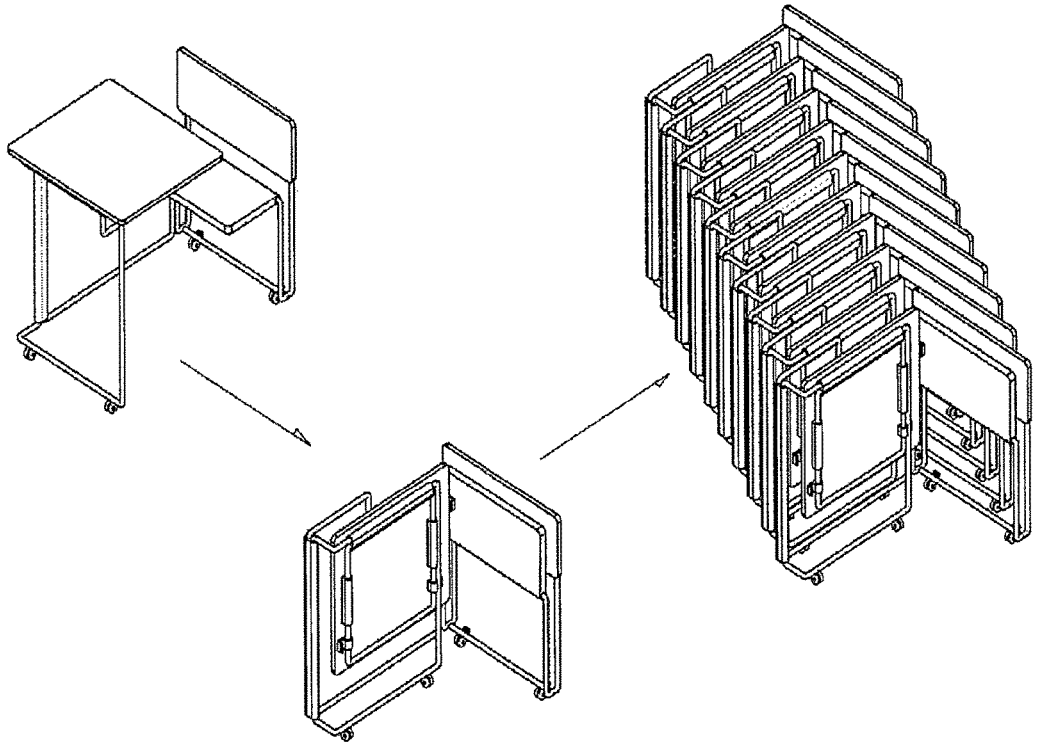
[Fig. 10]
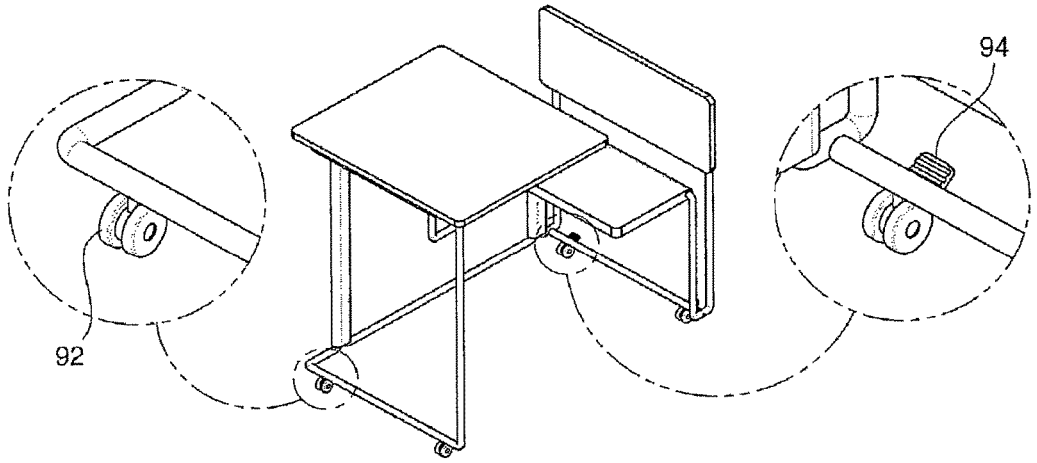

FOLDABLE DESK WITH FOLDABLE CHAIR

TECHNICAL FIELD

The present invention relates to a foldable desk with a foldable chair, and particularly, to a foldable desk, in which a desk board is movable in front and back directions so as to fit a body shape of a user and a chair and a desk are completely foldable and overlap for space utilization.

BACKGROUND ART

An integrated desk, in which a chair and a desk are integrated, has a problem of occupying a large space when being not used and is stored as illustrated in FIG. 1. In this case, there is a problem in that it takes considerable delivery costs, and a wide storage is required for storing the integrated chair.

In the meantime, there is an integrated desk, in which a chair and a desk are foldable among the integrated desks, and Korean Utility Model No. 368207 discloses "Structure of Foldable Chair Provided with Desk" as the desk of the aforementioned kind. However, the foregoing desk has a complex structure which causes an increase in manufacturing costs, and it is impossible to adjust an interval between the desk and the chair so as to fit a body shape of a user, and further, an area of a support part is small and the desk is easily shaken in front and back directions, so that stability is insufficient.

SUMMARY OF THE INVENTION

The present invention has been made in an effort to provide a foldable desk, which has a simple structure and is easily manufactured, and in which a desk and a chair are completely foldable and overlap, so that a space required for a delivery and a storage is minimized, thereby decreasing delivery costs and storage costs.

An exemplary embodiment of the present invention provides a foldable desk with a foldable chair, the foldable desk including: a quadrangular desk board frame 50 which is attached onto a bottom surface of a desk board 10 shaped like a quadrangular plate and is formed of a pipe; a quadrangular desk board support frame 60, which is connected to the desk board frame 50, stands on a ground to be supported, and is formed of a pipe; a backrest support frame 70, which is attached to a rear surface of a backrest 20 shaped like a quadrangular plate to support the backrest, includes a first leg and a second leg 72 and 74, is formed of a pipe, and is shaped like an inverse U-shape; a chair seat 40, which is shaped like a quadrangular plate and is rotatably connected to an intermediate upper edge 76, the intermediate upper edge 76 being bent from lower ends of the first leg and the second leg 72 and 74 of the backrest support frame 70 upwardly at 180° and rising up to an intermediate height; and a connection frame 30, which connects the desk board support frame 60 and the backrest support frame 70, is formed of a pipe, stands on a ground, and is generally shaped like "U", in which a frame 50 of the desk board 10 is rotatably connected to the desk board support frame 60 through a connection rod 13, the desk board support frame 60 is bent at a right angle in a state where the desk board 10 is accurately positioned at a position, at which the desk board 10 exerts a function of a desk, and a first upper edge 62 of a desk board support frame having a larger length than a thickness of the desk board and a first upper edge 32 of the connection frame 300 simultaneously support the bottom surface of the desk board 10, the connection rod 13 is shorter than a second upper edge 64 of the desk board support frame 60 coupled to the connection rod 13 to allow the desk board 10 to slide next to the first upper edge 62 of the desk board support frame, and the desk board 10 may be bent downwardly at a right angle in the state where the desk board 10 has slide next to the first upper edge 62 of the desk board support frame, when the chair seat 40 is in an accurately positioned state, in which the chair seat 40 serves as a chair, a bottom surface of the chair sheet is supported to a support part 35 protruding to an inner side of a second upper edge 34 lower than the first upper edge 32 of the connection frame 30, and the chair sheet 40 is completely folded upwardly and overlap the backrest 20, and the backrest support frame 70 is foldable at a right angle so as to overlap the connection frame 30 in the state where the chair seat 40 is folded upwardly, and the protruding part 35 is accurately positioned in a space between the first leg and the second leg 72 and 74 of the backrest support frame in the folded state of the backrest support frame 70.

Another exemplary embodiment of the present invention provides a foldable desk with a foldable chair, the foldable desk including: a quadrangular desk board frame 50 which is attached onto a bottom surface of a desk board 10 shaped like a quadrangular plate and is formed of a pipe; a quadrangular desk board support frame 60, which is connected to the desk board frame 50, stands on a ground to be supported, and is formed of a pipe; a backrest support frame 70, which is attached to a rear surface of a backrest 20 shaped like a quadrangular plate to support the backrest, includes a first leg and a second leg 72 and 74, is formed of a pipe, and is shaped like an inverse U-shape; a chair seat 40, which is shaped like a quadrangular plate and is rotatably connected to an intermediate upper edge 76, the intermediate upper edge 76 being bent from lower ends of the first leg and the second leg 72 and 74 of the backrest support frame 70 upwardly at 180° and rising up to an intermediate height; and a connection frame 30, which connects the desk board support frame 60 and the backrest support frame 70, is formed of a pipe, stands on a ground, and is generally shaped like "U", in which a frame 50 of the desk board 10 is rotatably connected to the desk board support frame 60 through a connection rod 13, the desk board support frame 60 is bent at a right angle in a state where the desk board 10 is accurately positioned at a position, at which the desk board 10 exerts a function of a desk, and a first upper edge 62 of a desk board support frame having a larger length than a thickness of the desk board and a first upper edge 32 of the connection frame simultaneously support the bottom surface of the desk board 10, the connection rod 13 is shorter than a second upper edge 64 of the desk board support frame 60 coupled to the connection rod 13 to allow the desk board 10 to slide next to the first upper edge 62 of the desk board support frame, and the desk board 10 may be bent downwardly at a right angle in the state where the desk board 10 has slide next to the first upper edge 62 of the desk board support frame, the desk board support frame 60 is foldable so as to overlap the connection frame 30 in the state where the desk board 10 is completely folded downwardly, and when the chair seat 40 is in an accurately positioned state, in which the chair seat 40 serves as a chair, a bottom surface of the chair sheet is supported to a support part 35 protruding to an inner side of a second upper edge 34 lower than the first upper edge 32 of the connection frame 30, and the chair sheet 40 is completely folded upwardly and overlap the backrest 20.

The chair seat 40 may be folded, the backrest support frame 70 may be folded so as to overlap the connection frame 30, and then the desk board 10, which is completely folded downwardly, and the desk board support frame 60 may be foldable so as to overlap the backrest support frame 70.

The desk board 10 may be coupled to both vertical rods 52 and 54 of the desk board frame 50 by a pipe type connection rod 12, and the connection rod 12 may be fixed to the desk board 10, may be shorter than both vertical rods 52 and 54, and may be movable along both vertical rods to enable the desk board 10 to move in front and back directions along both vertical rods.

A clip connection unit 53 may be installed in one vertical rod 52 of the desk board frame 50, and the clip connection unit 53 may be coupled to the first upper edge 32 of the connection frame 30 in a clip type.

A second clip connection unit 55 may be installed in the other vertical rod 54 of the desk board frame 50, and the clip connection unit 55 may be coupled to the leg 63 of the desk board support frame 60 in a clip type in the state where the desk board is folded.

A clip connection unit 42 coupled to the support part 35 in a clip type may be attached to the bottom surface of the chair seat 40.

The foldable desk according to the present invention has a simple structure and occupies a minimum space in a folded state, so that it is possible to minimize delivery costs and repair and maintenance costs, and adjust the desk board so as to fit a body shape of a user, thereby considerably increasing convenience for the user. Further, the chair seat and the desk board may be completely coupled to the frame even in the state where the desk is folded, as well as the case where the foldable desk is used as a desk, thereby considerably improving stability.

BRIEF DESCRIPTION OF THE DRAWINGS

FIG. 1 is a perspective view of a foldable desk integrated with a chair according to the present invention.

FIGS. 2-1 to 2-8 are perspective views illustrating processes of folding the foldable desk.

FIG. 3 is a lateral view illustrating the state where a desk board moves in front and back directions.

FIG. 4 is a perspective view of FIG. 2-5 viewed in another direction.

FIG. 5 is a perspective view illustrating a process of folding a chair seat in a direction of an arrow C in the state where the desk board is folded.

FIG. 6 is a perspective view and a partially enlarged view of an exemplary embodiment, in which a desk board support frame 60 is fixed to a connection frame 30 so as not to be rotatable.

FIG. 7 is a perspective view illustrating the state where the desks folded in a form of "¬" by folding only backrests of the present invention overlap and are stored.

FIG. 8 is a perspective view illustrating a structure, in which a backrest support frame 70 and a connection part 82 of the connection frame 30 are welded to fix both frames 70 and 30 so as not to rotate with respect to each other.

FIG. 9 is a perspective view illustrating the state where the desks folded in a form of "¬" by folding only the desk boards of the present invention overlap and are stored.

FIG. 10 is a perspective view of an exemplary embodiment, in which wheels are provided to the foldable desk of the present invention.

DETAILED DESCRIPTION

FIG. 1 is a perspective view of a foldable desk integrated with a chair according to the present invention, and FIGS. 2-1 to 2-8 are perspective views illustrating processes of folding the foldable desk.

As illustrated in FIGS. 1 and 2-1 to 2-8, a quadrangular desk board frame 50 formed of a pipe is attached onto a bottom surface of a desk board 10 shaped like a quadrangular plate. A quadrangular desk board support frame 60 formed of a pipe is connected to the desk board frame 50, and the support frame stands on the ground.

A backrest support frame 70, which is also formed of a pipe and is shaped like an inverse U-shape, is attached to a rear surface of a backrest 20 shaped like a quadrangular plate to support the backrest, and the support frame 70 includes a first leg and a second leg 72 and 74, and is bent from lower ends of the first leg and the second leg 72 and 74 upwardly at 180°, so that the first leg and the second leg 72 and 74 are connected to each other at an intermediate height that is a lower than that of the backrest to form an intermediate upper edge 76, and a chair seat 40 shaped like a quadrangular plate is rotatably connected to the intermediate upper edge.

The backrest support frame 70 and the desk board support frame 60 are connected to each other through a connection frame 30, which is formed of a pipe, and generally has a U-shape. The connection frame 30 stands on the ground, and is rotatable with respect to any one of or both the desk board support frame 60 and the backrest support frame 70 as necessary.

The frame 50 of the desk board 10 is rotatably connected to the desk board support frame 60 through a connection rod 13 (see FIG. 2-3). The connection rod 13 may have a form accommodating the two pipes, which form the desk board frame 50 and the support frame 60, in parallel.

As illustrated in FIG. 1, in the state where the desk board 10 is accurately positioned at a position exerting a function of the desk, the desk board support frame 60 forms a portion bent at a right angle. A length of the bent portion needs to be larger than a thickness of the desk board, and the reason thereof will be described below. An upper portion of the bent portion forms a first upper edge 62 of the desk board support frame, and a portion connected to the first upper edge 62 forms a first upper edge 32 of the connection frame 30, and the two upper edges 62 and 32 simultaneously support the bottom surface of the desk board 10 (see FIG. 2-2).

The connection rod 13 is shorter than a second upper edge 64 of the desk board support frame 60 coupled to the connection rod 13 to allow the desk board 10 to slide in a lateral direction that is a direction of an arrow A along the first upper edge 62 of the desk board support frame (see FIG. 2-3). As illustrated in FIGS. 2-3 and 2-4, the desk board 10 is foldable downwardly, that is, in a direction of an arrow B, at a right angle in the state of sliding in the direction of the arrow (A) (see FIG. 2-5). To this end, a length of a portion of the desk board support frame 60 bent at the right angle, that is, the first upper edge 62 of the desk board frame, needs to be larger than the thickness of the desk board. That is, when the desk board is completely folded, the desk board needs to be completely accommodated in the bent portion (see FIG. 2-5).

As illustrated in FIG. 1 to FIG. 2-5, when the chair seat 40 is in an accurately positioned state, in which the chair seat 40 serves as a chair, a second upper edge 34 lower than the first upper edge 32 of the connection frame 30 forms an inwardly protruding support part 35, and a bottom surface of the chair seat is supported to the support part 35.

As illustrated in FIG. 2-6, the chair seat 40 may be completely folded upwardly in a direction of an arrow C to overlap the backrest 20.

Subsequently, in the state where the chair seat 40 is folded upwardly, the backrest support frame 70 may be folded at a right angle so as to overlap the connection frame 30 as illustrated in FIG. 2-7. In this state, the protruding part 35 is positioned in a space between the first leg and the second leg 72 and 74 of the backrest support frame, and subsequently, the desk board support fame 60 may be rotated in a direction of an arrow D in the state where the desk board 10 is completely folded downwardly to be folded so as to overlap the backrest support frame 70. FIG. 2-8 is a perspective view illustrating the state where the desk board and the chair seat are completely folded so as to overlap each other.

In the meantime, as illustrated in FIG. 2-3, the desk board 10 is coupled to both vertical rods 52 and 54 of the desk board frame 50 by a pipe-type connection rod 12, and the connection rod 12 is fixed to the desk board 10, and may be better to have a smaller length than that of both vertical rods 52 and 54 and be movable along both vertical rods. In this case, the desk board 10 is movable in front and back directions along both vertical rods, so that the desk board 10 is movable in the front and back directions so as to fit a body shape of a user (see FIG. 3).

FIG. 3 is a lateral view illustrating the state where the desk board 10 moves in the front and back directions, and the desk board 10 is moved in a direction of an arrow E with respect to both vertical rods 52 and 54 of the desk board frame 50 to adjust a gap between the desk board 10 and the backrest to fit the body shape of the user.

A circle of FIG. 2-2 is an enlarged view of a corner of the desk board frame 50, and a clip connection unit 53 may be installed in one vertical rod 52 of the desk board frame 50, and the clip connection unit 53 may be coupled to the first upper edge 32 of the connection frame in a clip type. When the clip connection unit 53 is coupled to the first upper edge 32, the desk board 10 does not move and is fixed.

A second clip connection unit 55 having the same structure as that of the clip connection unit 53 is installed in another vertical rod 54 of the desk board frame 50. FIG. 4 is a perspective view of FIG. 2-5 viewed in another direction, and illustrates the state where the clip connection unit 55 is coupled to the leg 63 of the desk board support frame 60 in the clip type in the state where the desk board 10 is folded. In this case, the desk board in the folded state does not move and is fixed during the movement.

FIG. 5 is a perspective view and a partially enlarged view illustrating the state where the chair seat 40 is coupled to or separated from the support part 35, and a clip connection unit 42 coupled to the support part 35 in the clip type may be installed on the bottom surface of the chair seat 40. When the chair seat is coupled to the support part through the clip connection unit 42, the chair seat does not move, thereby securing stability.

In the meantime, in the aforementioned exemplary embodiment, both the backrest support frame 70 and the desk board support frame 60 are rotatable with respect to the connection frame 30, but the present invention may be configured so that only any one of the backrest support frame 70 and the desk board support frame 60 is rotatable as necessary.

FIG. 6 is a perspective view and a partially enlarged view of an exemplary embodiment, in which the desk board support frame 60 is fixed to the connection frame 30 so as not to be rotatable. As illustrated, when a connection part 80 of both frames 30 and 60 is coupled by a welding method, and the like, the desk board support frame 60 is prevented from being rotated. In this case, the desks, which are folded in the form of "¬" by folding only the backrests, of the present invention may overlap and be stored as illustrated in FIG. 7.

In contrast to FIG. 7, FIG. 8 illustrates a structure, in which the backrest support frame 70 and the connection part 82 of the connection frame 30 are welded to fix both frames 70 and 30 so as not to rotate with respect to each other. In this case, the desks, which are folded in the form of "¬" by folding only the desk plates, of the present invention may overlap and be stored as illustrated in FIG. 9.

FIG. 10 is a perspective view of an exemplary embodiment, in which wheels are provided to the foldable desk of the present invention. Wheels are attached to a bottom part of the desk of the present invention, and when a rotatable wheel 92 having no brake is attached to one side of the desk and a wheel 94 having a brake, which prevents the wheel from being rotated as necessary, is attached to an opposite side, it is possible to easily move and fix the desk.

What is claimed is:

1. A foldable desk with a foldable chair, the foldable desk comprising:

a quadrangular desk board frame (50) which is attached onto a bottom surface of a quadrangular plate-shaped desk board (10) and is formed of a pipe;

a quadrangular desk board support frame (60), which is connected to the desk board frame (50), stands on a ground to be supported, and is formed of a pipe;

a backrest support frame (70), which is attached to a rear surface of a quadrangular plate-shaped backrest (20) to support the backrest, includes a first leg and a second leg (72 and 74), is also formed of a pipe, and has an inverted U-shape;

a quadrangular plate-shaped chair seat (40), which is rotatably connected to an intermediate upper edge (76), the intermediate upper edge (76) being bent from lower ends of the first leg and the second leg (72 and 74) of the backrest support frame (70) upwardly at 180° and rising up to an intermediate height; and a connection frame (30), which connects the desk board support frame (60) and the backrest support frame (70), is formed of a pipe, stands on a ground, and is generally U-shaped, wherein a frame (50) of the desk board (10) is rotatably connected to the desk board support frame (60) through a connection rod (13), the desk board support frame (60) is bent at a right angle in a state where the desk board (10) is accurately positioned at a position, at which the desk board (10) functions as a desk, and a first upper edge (62) of the desk board support frame having a larger length than a thickness of the desk board and a first upper edge (32) of the connection frame simultaneously support the bottom surface of the desk board (10), the connection rod (13) is shorter than a second upper edge (64) of the desk board support frame (60) coupled to the connection rod (13) to allow the desk board (10) to slide next to the first upper edge (62) of the desk board support frame, and the desk board (10) is bent downwardly at a right angle in the state where the desk board (10) has slid next to the first upper edge (62) of the desk board support frame, when the chair seat (40) is in an accurately positioned state, in which the chair seat (40) serves as a chair, a bottom surface of the chair seat is supported to a support part (35) protruding to an inner side of a second upper edge (34) lower than the first upper edge (32) of the connection frame (30), and the chair seat (40) is completely folded upwardly and overlaps the backrest (20), and the backrest support frame (70) is foldable at a right angle so as to overlap the connection frame (30) in the state where the chair seat (40) is folded upwardly, and the support part (35) is positioned in a space between the first leg and the second leg (72 and 74) of the backrest support frame in the folded state of the backrest support frame (70).

2. A foldable desk including a foldable chair, the foldable desk comprising:

a quadrangular desk board frame (50) which is attached onto a bottom surface of a quadrangular plate-shaped desk board (10) and is formed of a pipe;

a quadrangular desk board support frame (60), which is connected to the desk board frame (50), stands on a ground to be supported, and is formed of a pipe;

a backrest support frame (70), which is attached to a rear surface of a quadrangular plate-shaped backrest (20) to support the backrest, includes a first leg and a second leg (72 and 74), is also formed of a pipe, and has an inverted U-shape;

a quadrangular plate-shaped chair seat (40), which is rotatably connected to an intermediate upper edge (76), the intermediate upper edge 76 being bent from lower ends of the first leg and the second leg (72 and 74) of the backrest support frame (70) upwardly at 180° and rising up to an intermediate height; and a connection frame (30), which connects the desk board support frame (60) and the backrest support frame (70), is formed of a pipe, stands on a ground, and is generally U-shaped, wherein the frame (50) of the desk board (10) is rotatably connected to the desk board support frame (60) through a connection rod (13), the desk board support frame (60) is bent at a right angle in a state where the desk board (10) is accurately positioned at a position, at which the desk board (10) functions as a desk, and a first upper edge (62) of the desk board support frame having a larger length than a thickness of the desk board and a first upper edge (32) of the connection frame (30) simultaneously support the bottom surface of the desk board (10), the connection rod (13) is shorter than a second upper edge (64) of the desk board support frame (60) coupled to the connection rod (13) to allow the desk board (10) to slide next to the first upper edge (62) of the desk board support frame, and the desk board (10) is bent downwardly at a right angle in the state where the desk board (10) has slid next to the first upper edge (62) of the desk board support frame, the desk board support frame (60) is foldable so as to overlap the connection frame (30) in the state where the desk board (10) is completely folded downwardly, and when the chair seat (40) is in an accurately positioned state, in which the chair seat (40) serves as a chair, a bottom surface of the chair seat is supported to a support part (35) protruding to an inner side of a second upper edge (34) lower than the first upper edge (32) of the connection frame (30), and the chair seat (40) is completely folded upwardly and overlaps the backrest (20).

3. The foldable desk of claim 2, wherein the chair seat (40) is folded, the backrest support frame (70) is folded so as to overlap the connection frame (30), and then the desk board (10), which is completely folded downwardly, and the desk board support frame (60) are foldable so as to overlap the backrest support frame (70).

4. The foldable desk of claim 3, wherein the desk board (10) is coupled to the vertical rods (52 and 45) of the desk board frame (50) by a pipe type connection rod (12), and the connection rod (12) is fixed to the desk board (10), is shorter than the vertical rods (52 and 54) and is movable along the vertical rods to enable the desk board (10) to move in front and back directions along the vertical rods.

5. The foldable desk of claim 4, wherein a first clip connection unit (53) is installed in one of the vertical rods of the desk board frame (50), and the first clip connection unit (53) is coupled to the first upper edge (32) of the connection frame (30).

6. The foldable desk of claim 5, wherein a second clip connection unit (55) is installed in another of the vertical rods of the desk board frame (50), and the second clip connection unit (55) is coupled to the leg (63) of the desk board support frame (60) in the state where the desk board is folded.

7. The foldable desk of claim 6, wherein a third clip connection unit (42) coupled to the support part (35) is attached to the bottom surface of the chair seat (40).

8. The foldable desk of claim 1, wherein the chair seat (40) is folded, the backrest support frame (70) is folded so as to overlap the connection frame (30), and then the desk board (10), which is completely folded downwardly, and the desk board support frame (60) are foldable so as to overlap the backrest support frame (70).

9. The foldable desk of claim 8, wherein the desk board has vertical rods (52 and 54), the desk board (10) being coupled to the vertical rods (52 and 54) of the desk board frame (50) by a pipe type connection rod (12), and the connection rod (12) is fixed to the desk board (10), is shorter than the vertical rods (52 and 54), and is movable along the vertical rods to enable the desk board (10) to move in front and back directions along the vertical rods.

10. The foldable desk of claim 9, wherein a first clip connection unit (53) is installed in one of the vertical rods of the desk board frame (50), and the first clip connection unit (53) is coupled to the first upper edge (32) of the connection frame (30).

11. The foldable desk of claim 10, wherein a second clip connection unit (55) is installed in another of the vertical rods of the desk board frame (50), and the second clip connection unit (55) is coupled to the leg (63) of the desk board support frame (60) in the state where the desk board is folded.

12. The foldable desk of claim 11, wherein a third clip connection unit (42) coupled to the support part (35) is attached to the bottom surface of the chair seat (40).

* * * * *